US012571139B2

(12) United States Patent
Yu et al.

(10) Patent No.: US 12,571,139 B2
(45) Date of Patent: Mar. 10, 2026

(54) BIOMIMETIC THERMAL REGULATING FABRIC AND METHOD FOR CONSTRUCTING THE SAME

(71) Applicant: City University of Hong Kong, Hong Kong (HK)

(72) Inventors: Xinge Yu, Hong Kong (HK); Lung Chow, Hong Kong (HK); Xingcan Huang, Hong Kong (HK); Qiang Zhang, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 138 days.

(21) Appl. No.: 18/604,516

(22) Filed: Mar. 14, 2024

(65) Prior Publication Data

US 2025/0075383 A1 Mar. 6, 2025

Related U.S. Application Data

(60) Provisional application No. 63/580,990, filed on Sep. 6, 2023.

(51) Int. Cl.
*D04B 1/14* (2006.01)
*D04B 1/24* (2006.01)

(52) U.S. Cl.
CPC ..... *D04B 1/246* (2013.01); *D04B 1/14* (2013.01); *D10B 2401/022* (2013.01); *D10B 2401/20* (2013.01); *D10B 2501/04* (2013.01)

(58) Field of Classification Search
CPC . D04B 1/10; D04B 1/14; D04B 1/102; D04B 1/104; D04B 1/246; D04B 7/24;
(Continued)

(56) References Cited

U.S. PATENT DOCUMENTS 1,852,936 A * 4/1932 Ernst ..... D04B 1/104 66/96 R
2,036,702 A * 4/1936 Krenkel ..... D04B 9/54 2/140

(Continued)

FOREIGN PATENT DOCUMENTS

TW 1433971 B * 4/2014 ..... A43B 1/028
TW M494793 U * 2/2015
WO WO-2007107723 A1 * 9/2007 ..... A41D 31/125

OTHER PUBLICATIONS

K. M. Baudier et al., Structure and thermal biology of subterranean army ant bivouacs in tropical montane forests, Insectes Sociaux, 2016, vol. 63, p. 467-476.

(Continued)

*Primary Examiner* — Danny Worrell
(74) *Attorney, Agent, or Firm* — Idea Intellectual Limited; Sam T. Yip

(57) ABSTRACT

A biomimetic thermal regulating fabric (BTRF) imitating army ant bivouacs and a method for constructing the same are provided. The BTRF comprises a plurality of yarns formed of textile fibres having a water-actuated crimp behaviour, wherein the plurality of yarns is knitted by means of transfer stitch to form an unsymmetrical fabric structure which has a positive water-actuated expansion rate along a first axis and a negative water-actuated expansion rate along a second axis orthogonal to the first axis. Surfaces of the textile fibres are plasma-treated to have one or more hydrophilic functional groups. One or more colorimetric fabric sensors are incorporated to generate colours in response to one or more ambient environmental conditions or user physiological conditions respectively. The present invention has excellent scalability, biocompatibility, and great dynamic durability, and is advantageous for applications in athletic wear, outdoor wear, and medical textiles.

15 Claims, 26 Drawing Sheets
(5 of 26 Drawing Sheet(s) Filed in Color)

(58) Field of Classification Search
CPC ... D04B 7/28; D04B 9/26; D04B 9/38; D04B 21/10; D04B 21/12
See application file for complete search history.

(56) References Cited

U.S. PATENT DOCUMENTS

| | | | | |
|---|---|---|---|---|
| 4,079,602 | A * | 3/1978 | Blore | D04B 1/14 66/196 |
| 5,379,615 | A * | 1/1995 | Shima | D04B 1/106 66/189 |
| 7,389,657 | B2 * | 6/2008 | Lonati | D04B 1/104 66/215 |
| 9,732,451 | B2 * | 8/2017 | Lee | D04B 9/42 |
| 2017/0172227 | A1 * | 6/2017 | Fan | A41D 13/0025 |
| 2017/0350043 | A1 * | 12/2017 | Lai | D02G 3/04 |
| 2019/0208862 | A1 * | 7/2019 | Poegl | A43B 23/025 |
| 2022/0074091 | A1 * | 3/2022 | Poegl | D04B 7/28 |
| 2023/0228009 | A1 * | 7/2023 | Lai | D03D 13/00 |
| 2024/0309567 | A1 * | 9/2024 | Rendfrey | D04B 1/22 |
| 2025/0075383 | A1 * | 3/2025 | Yu | D04B 1/12 |

OTHER PUBLICATIONS

T. W. Soare et al., Choice of nest site protects army ant colonies from environmental extremes in tropical montane forest, Insectes Sociaux, 2011, vol. 58, p. 299-308.
Rachael L. Morton et al., Risk attitudes and sun protection behaviour: Can behaviour be altered by using a melanoma genomic risk intervention?, Cancer Epidemiology, 2019, vol. 61, p. 8-13.
Xingcan Huang et al., Intelligent Soft Sweat Sensors for the Simultaneous Healthcare Monitoring and Safety Warning, Advanced Healthcare Materials, 2023, vol. 12, No. 2202846, p. 1-10.
Xingcan Huang et al., Stretchable magnesium-air battery based on dual ions conducting hydrogel for intelligent biomedical applications, InfoMat, 2023, vol. 5, No. e12388, p. 1-13.
Dae-Hyeong Kim et al., Epidermal Electronics, Science, 2011, vol. 333, p. 838-843.
Yifei Luo et al., Technology Roadmap for Flexible Sensors, ACS Nano, 2023, vol. 17, p. 5211-5295.
Julia C. Jones et al., Nest Thermoregulation in Social Insects, Advances in Insect Physiology, 2006, vol. 33, p. 153-191.
Thomas Bochynek et al., Anatomy of a superorganism—structure and growth dynamics of army ant bivouacs, 2021, p. 1-13.
Nigel R. Franks, Thermoregulation in army ant bivouacs, Physiological Entomology, 1989, vol. 14, p. 397-404.
R. M. Morgan et al., Acute effects of dehydration on sweat composition in men during prolonged exercise in the heat, Acta Physiologica Scandinavica, 2004, vol. 182, p. 37-43.
Dong Liu et al., Wearable Microfluidic Sweat Chip for Detection of Sweat Glucose and pH in Long-Distance Running Exercise, Biosensors, 2023, vol. 13, No. 157, p. 1-11.
Andrew P. Negri et al., A Model for the Surface of Keratin Fibers, Textile Research Journal, 1993, vol. 63, p. 109-115.
Rahul Navik et al., Influence of dielectric barrier discharge treatment on mechanical and dyeing properties of wool, Plasma Science and Technology, 2018, vol. 20, No. 065504, p. 1-10.
P. Erra et al., Shrinkage Properties of Wool Treated with Low Temperature Plasma and Chitosan Biopolymer, Textile Research Journal, 1999, vol. 69, p. 811-815.
Stefano Zanini et al., Characterization of atmospheric pressure plasma treated wool/cashmere textiles: Treatment in nitrogen, Applied Surface Science, 2018, vol. 427, p. 90-96.
Fernando Ribeiro Oiliveira et al., Functionalization of wool fabric with phase-change materials microcapsules after plasma surface modification, Journal of Applied Polymer Science, 2013, vol. 128, p. 2638-2647.
K. Sato et al., Biology of sweat glands and their disorders. I. Normal sweat gland function, Journal of the American Academy of Dermatology, 1989, vol. 20, No. 4, p. 537-563.
Wen Wang et al., Natural alginate fiber-based actuator driven by water or moisture for energy harvesting and smart controller applications, Journal of Materials Chemistry A, 2018, vol. 6, p. 22599-22608.
Ying Zhong et al., Reversible Humidity Sensitive Clothing for Personal Thermoregulation, Scientific Reports, 2017, vol. 7, No. 44208, p. 1-8.
Jiuke Mu et al., Molecular-channel driven actuator with considerations for multiple configurations and color switching, Nature Communications, 2018, vol. 9, No. 590, p. 1-10.
Yangyang Peng et al., Free-standing single-helical woolen yarn artificial muscles with robust and trainable humidity-sensing actuation by eco-friendly treatment strategies, Smart Materials and Structures, 2022, vol. 31, No. 095017, p. 1-9.
Wen Wang et al., Harnessing the hygroscopic and biofluorescent behaviors of genetically tractable microbial cells to design biohybrid wearables, Science Advances, 2017, vol. 3, No. e1601984, p. 1-8.
Xu A. Zhang et al., Dynamic gating of infrared radiation in a textile, Science, 2019, vol. 363, p. 619-623.
Mohammad Irfan Iqbal et al., Knit Architecture for Water-Actuating Woolen Knitwear and Its Personalized Thermal Management, ACS Applied Materials & Interfaces, 2021, vol. 13, p. 6298-6308.
Jinlian Hu et al., Wool Can Be Cool: Water-Actuating Woolen Knitwear for Both Hot and Cold, Advanced Functional Materials, 2020, vol. 30, No. 2005033, p. 1-9.
Tianjiao Jia et al., Moisture Sensitive Smart Yarns and Textiles from Self-Balanced Silk Fiber Muscles, Advanced Functional Materials, 2019, vol. 29, No. 1808241, p. 1-12.
Yangyang Peng et al., Hierarchically Structured and Scalable Artificial Muscles for Smart Textiles, ACS Applied Materials & Interfaces, 2021, vol. 13, p. 54386-54395.
Joo-Seung Choi et al., Composite-fabric-based structure-integrated energy storage system, Composite Structures, 2023, vol. 310, No. 116757, p. 1-9.
Xiaoping Lin et al., Design and construction of 1D/2D/3D fabric-based wearable micro-supercapacitors, Journal of Power Sources, 2023, vol. 560, No. 232712, p. 1-23.
Tairan Wang et al., Large-scale production of the 3D warp knitted terry fabric triboelectric nanogenerators for motion monitoring and energy harvesting, Nano Energy, 2023, vol. 109, No. 108309, p. 1-10.
Lijun Chen et al., Stretchable Woven Fabric-Based Triboelectric Nanogenerator for Energy Harvesting and Self-Powered Sensing, Nanomaterials, 2023, vol. 13, No. 863, p. 1-14.
Yi Hao et al., Scalable, ultra-high stretchable and conductive fiber triboelectric nanogenerator for biomechanical sensing, Nano Energy, 2023, vol. 109, No. 108291, p. 1-11.
Hong Pan et al., Biodegradable cotton fiber-based piezoresistive textiles for wearable biomonitoring, Biosensors and Bioelectronics, 2023, vol. 222, No. 114999, p. 1-8.
Xin-Xin Dong et al., MXene-Decorated Smart Textiles with the Desired Mid-Infrared Emissivity for Passive Personal Thermal Management, ACS Applied Materials & Interfaces, 2023, vol. 15, p. 12032-12040.
J. Barritt, 13—The Literature of Keratin (The Principal Constituent of Wool, Journal of the Textile Institute Transactions, 1926, vol. 17, p. T111-T126.
P. I. Hynd et al., Wool fibre crimp is determined by mitotic asymmetry and position of final keratinisation and not ortho- and para-cortical cell segmentation, Animal, 2009, vol. 3, p. 838-843.
Devin J. Roach et al., Long Liquid Crystal Elastomer Fibers with Large Reversible Actuation Strains for Smart Textiles and Artificial Muscles, ACS Applied Materials & Interfaces, 2019, vol. 11, p. 19514-19521.
Eva V. Osilla et al., Physiology, Temperature Regulation, StatPearls, 2023, https://www.ncbi.nlm.nih.gov/books/NBK507838.
Lindsay B. Baker, Physiology of sweat gland function: The roles of sweating and sweat composition in human health, Temperature, 2019, vol. 6, p. 211-259.
Daniel Gagnon et al., Chapter 13—Sweating as a heat loss thermoeffector, Handbook of Clinical Neurology, 2018, vol. 156, p. 211-232.
Etain A. Tansey et al., Recent advances in thermoregulation, Advances in Physiology Education, 2015, vol. 39, p. 139-148.

(56) References Cited

OTHER PUBLICATIONS

Elizabeth G. Hanna et al., Limitations to Thermoregulation and Acclimatization Challenge Human Adaptation to Global Warming, International Journal of Environmental Research and Public Health, 2015, vol. 12, p. 8034-8074.
Raymond J. Geor et al., Thermoregulatory Adaptations Associated with Training and Heat Acclimation, Veterinary Clinics of North America: Equine Practice, 1998, vol. 14, No. 1, p. 97-120.
George Havenith, Interaction of Clothing and Thermoregulation, Exogenous Dermatology, 2002, vol. 1, p. 221-230.
Space Cooling, IEA Paris, 2022, https://www.iea.org/energy-system/buildings/space-cooling.
Po-Chun Hsu et al., Photon-engineered radiative cooling textiles, Science, 2020, vol. 370, No. 6518, p. 784-785.
Po-Chun Hsu et al., Radiative human body cooling by nanoporous polyethylene textile, Science, 2016, vol. 353, No. 6303, p. 1019-1023.
Lili Cai et al., Spectrally Selective Nanocomposite Textile for Outdoor Personal Cooling, Advanced Materials, 2018, vol. 30, No. 1802152, p. 1-7.
Shaoning Zeng et al., Hierarchical-morphology metafabric for scalable passive daytime radiative cooling, Science, 2021, vol. 373, p. 692-696.
Bin Zhu et al., Subambient daytime radiative cooling textile based on nanoprocessed silk, Nature Nanotechnology, 2021, vol. 16, p. 1342-1348.
Xiaoshuang Zhang et al., A Moisture-Wicking Passive Radiative Cooling Hierarchical Metafabric, ACS Nano, 2022, vol. 16, p. 2188-2197.
Chelsea N. Cook et al., Social context influences the initiation and threshold of thermoregulatory behaviour in honeybees, Animal Behaviour, 2013, vol. 86, p. 323-329.
Bernd Heinrich, Thermoregulation in Endothermic Insects, Science, 1974, vol. 185, p. 747-756.
James D. Crall et al., Neonicotinoid exposure disrupts bumblebee nest behavior, social networks, and thermoregulation, Science, 2018, vol. 362, p. 683-686.
SŜtêpánka Kadochová et al., Thermoregulation strategies in ants in comparison to other social insects, with a focus on red wood ants (Formica rufa group) [version 2; peer review: 2 approved, 1 approved with reservations], F1000 Research, 2014, vol. 2, No. 280, p. 1-16.
James K. Wetterer et al., Geographic distribution of Labidus coecus (Latr.) (Hymenoptera, Formicidae), a subterranean army ant, Journal of Hymenoptera Research, 2015, vol. 44, p. 31-38.

* cited by examiner

BIOMIMETIC THERMAL REGULATING FABRIC AND METHOD FOR CONSTRUCTING THE SAME

CROSS-REFERENCE TO RELATED APPLICATIONS

The present application claims priority from the U.S. Provisional Patent Application No. 63/580,990 filed on Sep. 6, 2023, and the disclosure of which is incorporated herein by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to biomimetic fabric technology. More specifically the present invention relates to a biomimetic thermal regulating fabric with colorimetric multi-sensing function.

BACKGROUND OF THE INVENTION

There is a significant temperature discrepancy between indoor and outdoor areas nowadays. A fabric that can adapt to different environments not only improves the quality of life, but also reduces the energy consumption to regulate indoor temperature. In the nature, different species have their own adaptation system to temperature.

Presently, there are three primary methods to accomplish the passive thermal regulation effect on a fabric: flapper opening, micro-pore opening, and directional shrinkage fabric.

In "flapper opening" approaches, the flappers on the clothing were made of moisture or water-sensitive materials, which will bend away from the body when they absorb perspiration, increasing airflow and radiation transmission. For instance, flapper opening effect of a garment was created by utilizing the property of commercial Nafion polymer film that has both hydrophobic backbone and hydrophilic side chains. Researchers have also suggested the use of various types of artificial muscle yarn including alginate and wool yarn to realize the flapper opening effect. Meanwhile, the flapper opening function has been demonstrated using the hygroscopic behavior of genetically tractable microbial cells. However, this approach has its critical drawback that the flapper opening motion can be seriously affected by an outerwear. When the flapper is covered by an external object, it is not possible to open it, which severely limits its effectiveness (see FIG. 27).

In "micro-pore opening" approaches, when the fabric is stimulated by moisture or water, the micro-pore can enlarge and become more thermal radiation permeable, resulting in the thermal regulation effect. For instance, an infrared-adaptive textile composed of polymer fibers coated with carbon nanotubes is constructed. The yarn thickness is altered in response to heat and humidity, which enlarge the size of the pores. More than that, the possibility of shape memory effect of wool yarn has been explored to fabricate the thermal regulating fabric. The wool yarn reduces its thickness when getting wet, causing the opening of micropores. On the other hand, the reduction of yarn thickness generally results in an increase in yarn length because of the twisted structure of yarn. Despite the fabric's micropores being expanded, the fabric has a larger fabric dimension. The increased fabric dimension may result in undesirable additional skin coverage, which would conflict with the fabric's capacity to regulate body temperature (see FIG. 28).

Different types of directional shrinkage fabrics are developed to obtain the adaptive permeability effect. For instance, a torsional silk yarn is developed to achieve the directional shrinkage effect of fabric. The concept of reducing sleeves length after absorbing moisture to reduce skin coverage is demonstrated in their studies. In addition, a sweat induced wool fabric which the sleeve can be rolled is developed. Nevertheless, once the fabric is shrunken or rolled, the density of the fabric increases in their demonstration and result in reduced both air and radiation permeability of fabric (see FIG. 29).

SUMMARY OF THE INVENTION

It is one objective of the present invention to provide a excellent scalable, biocompatible and durable fabric that can adapt to different environments. Inspired by army ant bivouacs, a biomimetic thermal regulating fabric (BTRF) is developed with unique knitting structure, which can response to perspiration promptly, absorb sweat rapidly and then transform its architecture to improve radiation transmission and air exchange. By integrating with colorimetric sensors, the provided intelligent BTRF is also capable of simultaneous and efficient monitoring of several critical condition changes (e.g., temperature, ultraviolet (UV) radiation, and pH), which is highly advantageous for applications in athletic wear, outdoor wear, and medical textiles.

In accordance with a first aspect of the present invention, the BTRF comprises: a plurality of yarns formed of textile fibres having a water-actuated crimp behaviour; and wherein the plurality of yarns is knitted by means of transfer stitch to form an unsymmetrical fabric structure which has a positive water-actuated expansion rate along a first axis and a negative water-actuated expansion rate along a second axis orthogonal to the first axis.

In one embodiment of the first aspect of the present invention, the textile fibres are wool fibres with surfaces containing one or more hydrophilic functional groups.

In one embodiment of the first aspect of the present invention, the BTRF further comprises one or more colorimetric fabric sensors configured to generate colours in response to one or more ambient environmental conditions or user physiological conditions respectively.

In one embodiment of the first aspect of the present invention, the one or more colorimetric fabric sensors include a pH level sensor configured to detect a pH level in a range of pH4 to pH7.

In one embodiment of the first aspect of the present invention, the one or more colorimetric fabric sensors include a UV radiation sensor configured to detect a UV radiation intensity in a range of 10 to 5000 $\mu W/cm^2$.

In one embodiment of the first aspect of the present invention, the one or more colorimetric fabric sensors include a temperature sensor configured to detect a temperature in a range of 34° C. to 40° C.

In accordance with a second aspect of the present invention, a method for constructing a BTRF is provided. The method comprises: preparing a plurality of yarns formed of textile fibres having a water-actuated crimp behaviour; and knitting the plurality of yarns by means of transfer stitch to form an unsymmetrical fabric structure which has a positive water-actuated expansion rate along a first axis and a negative water-actuated expansion rate along a second axis orthogonal to the first axis.

In one embodiment of the second aspect of the present invention, the textile fibres are wool fibres and the method further comprises processing the fabric structure with plasma treatment to form one or more hydrophilic functional groups on surfaces of the fabric structure.

In one embodiment of the second aspect of the present invention, the method further comprises screen-printing or dying one or more colorimetric fabric sensors on the fabric structure to generate colours in response to one or more ambient environmental conditions or user physiological conditions respectively.

In one embodiment of the second aspect of the present invention, the one or more colorimetric fabric sensors include a sweat pH level sensor configured to detect a sweat pH level in a range of pH4 to pH7.

In one embodiment of the second aspect of the present invention, the one or more colorimetric fabric sensors include a UV radiation sensor configured to detect a UV radiation intensity in a range of 10 to 5000 $\mu W/cm^2$.

In one embodiment of the second aspect of the present invention, the one or more colorimetric fabric sensors include a temperature sensor configured to detect a temperature in a range of 34° C. to 40° C.

In accordance with a third aspect of the present invention, a garment made of a BTRF is provided.

In one embodiment of the third aspect of the present invention, the garment comprises a pair of sleeves each sleeve being knitted with the biomimetic thermal regulating fabric to achieve an unsymmetrical fabric structure which has a negative water-actuated expansion rate along an arm axis and a positive water-actuated expansion rate along another axis orthogonal to the arm axis.

In one embodiment of the third aspect of the present invention, the garment comprises a pair of pants, each pant being knitted with the biomimetic thermal regulating fabric to achieve an unsymmetrical fabric structure which has a negative water-actuated expansion rate along a leg axis and a positive water-actuated expansion rate along another axis orthogonal to the leg axis.

The provided BTRF has excellent scalability, biocompatibility, and great dynamic durability, therefore commences a promising direction on the development of next-generation smart textiles for personal thermal management and health monitoring, while satisfying the growing demand for energy saving.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the invention are described in more details hereinafter with reference to the drawings, in which.

DETAILED DESCRIPTION

In the following description, details of the present invention are set forth as preferred embodiments. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

In accordance with various aspects of the present invention, a biomimetic thermal regulating fabric (BTRF), which is inspired by the thermal regulation system of the army ant bivouacs (nest), is provided.

Figure 1:
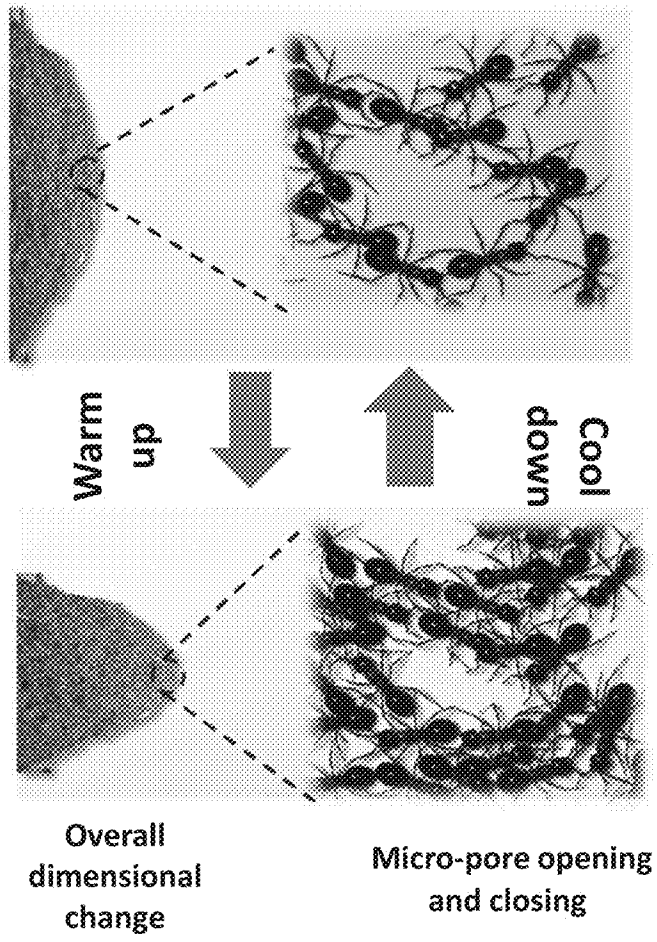
FIG. 1 illustrates thermal regulation system of the army ant bivouacs.

As shown in FIG. 1, army ants, unlike other ant species, construct their nests or bivouacs by interlocking their tarsal claws. To keep the temperature within the bivouac at a level that is favorable for the growth of the brood, the worker ants use two different strategies. First, the tiny pores created by the worker ants can be opened or closed. Second, bivouacs' overall shape can be changed to alter their surface area.

Figure 2:
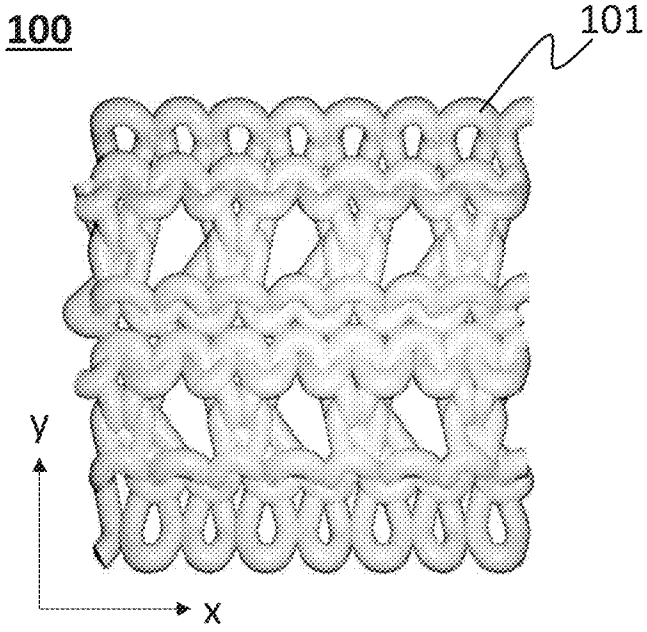
FIG. 2 shows a BTRF according to one embodiment of the present invention.

FIG. 2 shows a BTRF 100 according to one embodiment of the present invention. The BTRF 100 comprises a plurality of yarns 101 formed of textile fibres having a water-actuated crimp behaviour. For example, the textile fibres may be wool fibres with surfaces containing one or more hydrophilic functional groups. The plurality of yarns 101 is knitted by means of transfer stitch to form an unsymmetrical fabric structure which has a positive water-actuated expansion rate along a first axis (as indicated with the x-axis) and a negative water-actuated expansion rate along a second axis (as indicated with the y-axis) orthogonal to the first axis.

Figure 3:
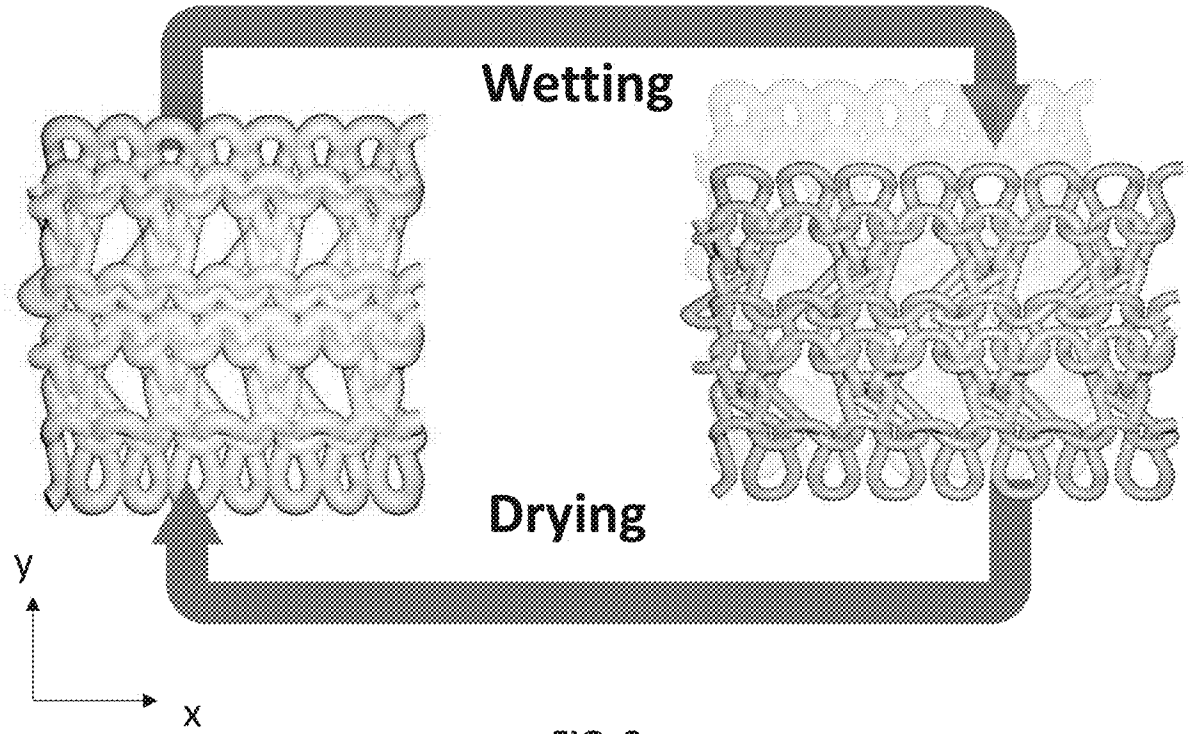
FIG. 3 illustrates the working mechanism of the BTRF.

FIG. 3 illustrates the working mechanism of the BTRF. Inspired by the thermal regulation system of army ant bivouacs, both micro-pore opening or closing and the overall structural transformation effect are utilized in the provided BTRF. Originally, the fabric was tightly suited to the skin to keep the bodies warm. As temperature getting warm, sweat from the body makes the fabric from dry to wet and triggers the fabric structure to expand along the x-axis and contract along the y-axis.

In some embodiments, the BTRF may further comprise one or more colorimetric fabric sensors configured to generate colours in response to one or more ambient environmental conditions or user physiological conditions respectively.

Figure 4A:
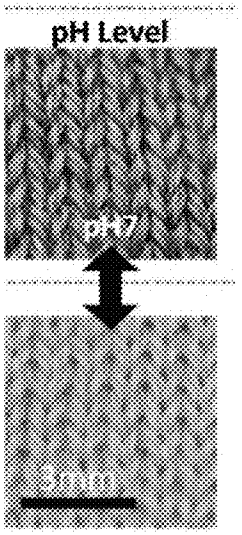
FIGS. 4A to 4C show colorimetric fabric sensors for sensing sweat pH level, temperature and UV radiation, respectively.

In some embodiments, the colorimetric fabric sensors may include a reversible colorimetric fabric pH level sensor configured to detect a sweat pH level of in a range of pH4 to pH7. For example, referring to FIG. 4A, the colorimetric fabric pH level sensor may be configured to have a yellow color at pH4 and a violet color at pH7.

Figure 4B:
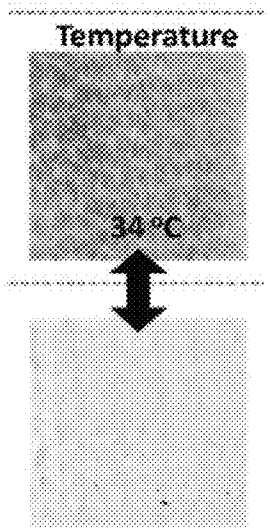

The colorimetric fabric sensors may further include a reversible colorimetric fabric temperature sensor configured to detect a temperature in a range of 34° C. to 40° C. For example, referring to FIG. 4B, the colorimetric fabric temperature sensor may be configured to have a bright red color at 34° C. and a lemon yellow color at 40° C.

Figure 4C:
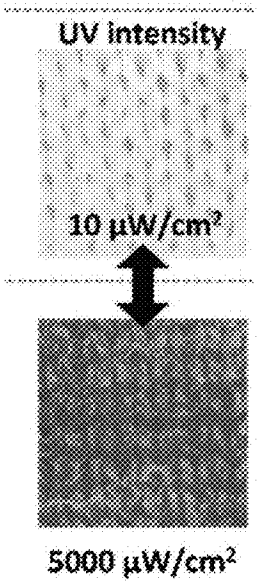

The colorimetric fabric sensors may further include a reversible colorimetric fabric UV radiation sensor configured to detect a UV radiation intensity in a range of 10 to 5000 $\mu W/cm^2$. For example, referring to FIG. 4C, the colorimetric fabric UV radiation sensor may be configured to have a light pink color at UV radiation intensity of 10 $\mu W/cm^2$ and a dark magenta color at UV radiation intensity of 5000 $\mu W/cm^2$.

Abnormal change of sweat pH can be an indication of body dehydration or muscle fatigue and alert the wearer to potential issues. Apart from that, the UV radiation intensity (up to 5000 $\mu W/cm^2$) and temperature (34-40° C.) colorimetric sensors reflect the environment status and prevent over exposure of UV radiation and heat stroke. With the reversible colorimetric sensors, the BTRF can have enhanced capabilities for being used as sportwear or outdoor garment, that respond to ultraviolet (UV) radiation, sweat pH level, and temperature. The color of the fabric can inform the wearer of the environment, helping them avoid prolonged UV radiation exposure, muscle exhaustion, and dehydration.

In some embodiments, a smart phone application may be developed, on basis of artificial intelligent (AI) technology, to cooperate with the BTRF to quantitatively analyze the color change of colorimetric sensors and provide a numerical data of the colorimetric sensors. The smart phone application may be further configured to warn the wearers promptly or provide feedback and suggestion to the wearers.

Figure 5A:
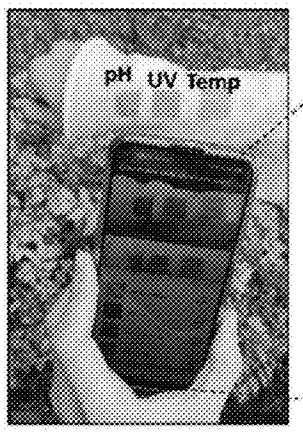
FIG. 5A illustrates how a user uses a smart phone application according to one embodiment of the present invention to turn the color of sensors into numerical values.
Figure 5B:
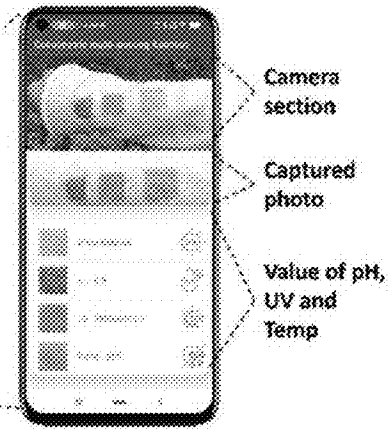
FIG. 5B shows an expanded graphical user interface of the smart phone application.
Figure 5C:
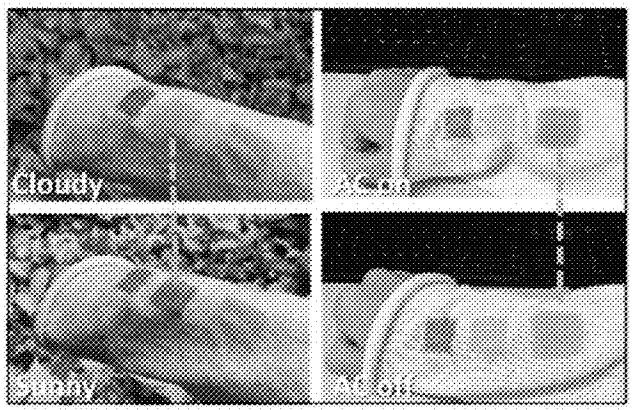
FIG. 5C shows colors of the colorimetric sensors change in various environments.

FIG. 5A illustrates how a user uses the developed smart phone application to turn the color of sensors into numerical values. FIG. 5B shows an expanded graphical user interface and details of the developed smart phone application. The numerical values of the colorimetric sensors can be processed using the developed algorithm after the user photographed the sensors and finished the white balancing procedure. If the discovered values are abnormal, the user will receive a reminder or warning. Additionally, the obvious color changes of the sensors in various environments can be easily noticed by human eyes as well (FIG. 5C).

Figure 6:
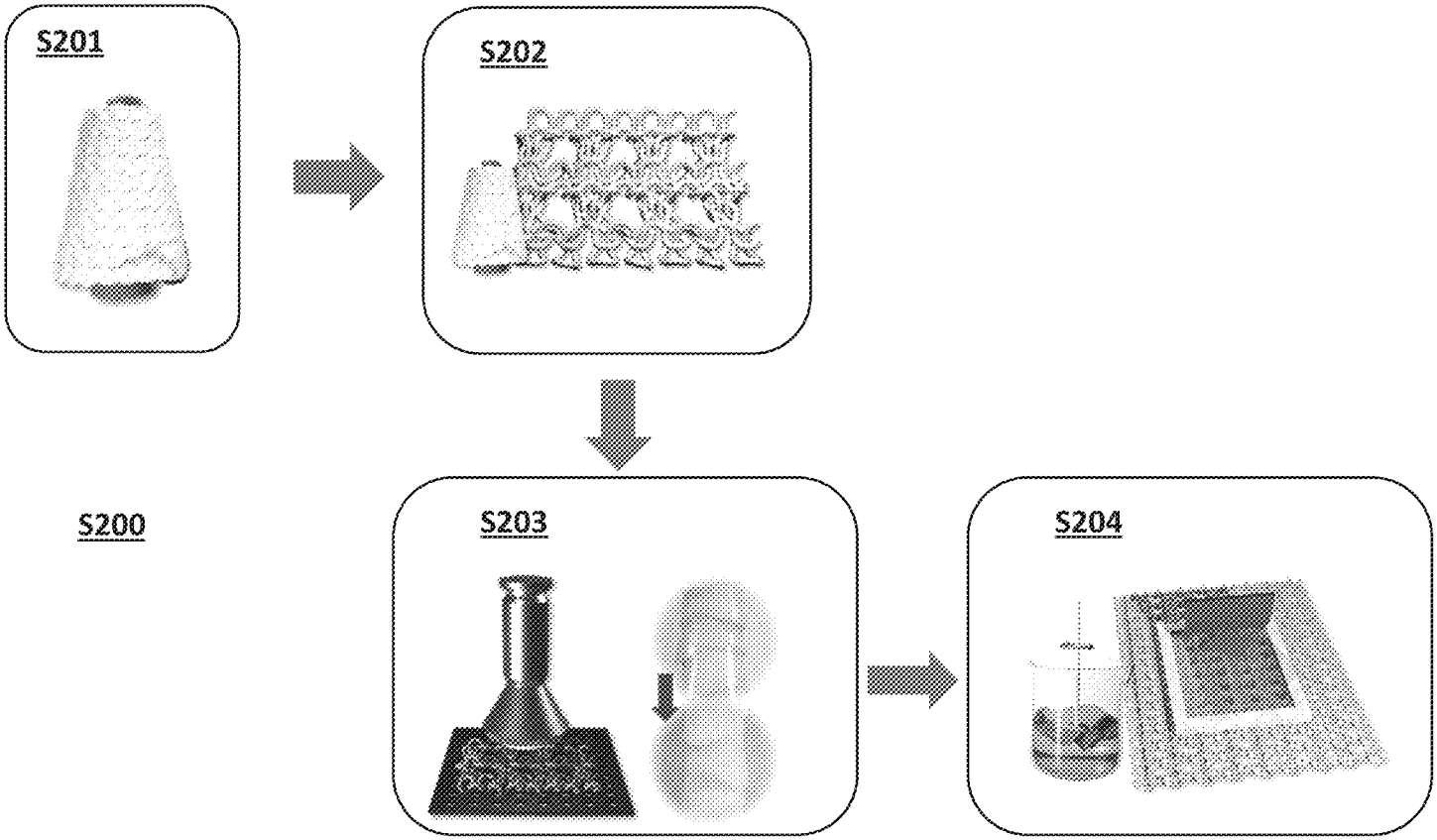
FIG. 6 shows a schematic chart of a method for constructing a BTRF according to one embodiment of the present invention.

FIG. 6 shows a schematic chart of a method S200 for constructing a BTRF according to one embodiment of the present invention. The method S200 may include:

Step S101: preparing a plurality of yarns formed of textile fibres having a water-actuated crimp behaviour, for example, the textile fibres may be wool fibres with surfaces containing one or more hydrophilic functional groups; and Step S102: knitting the plurality of yarns by means of transfer stitch to form an unsymmetrical fabric structure which has a positive water-actuated expansion rate along a first axis and a negative water-actuated expansion rate along a second axis orthogonal to the first axis;

Step S103: processing the fabric structure with plasma treatment to form one or more hydrophilic functional groups on surfaces of the fabric structure; and Step S104: screen-printing or dying one or more colorimetric fabric sensors on the fabric structure to generate colours in response to one or more ambient environmental conditions or user physiological conditions respectively.

The present invention has exploited the flexibility of knitting structure to achieve an ideal directional shrinkage and expansion of fabric actuated by water. In one implementation of the present invention, sleeves or pants of a cloth may be knitted with transfer stitch with the BTRF to achieve an unsymmetrical fabric structure which has a negative water-actuated expansion rate along the arm/leg axis and a positive water-actuated expansion rate along another axis orthogonal to the arm/leg axis. When a user wearing such a cloth is sweating, perspiration is absorbed, the lengths of the sleeves/pants are shortened, and the width of the sleeves/pants are increased, reducing the amount of cloth covering the skin and promote heat loss through convection and radiation.

Figure 7:
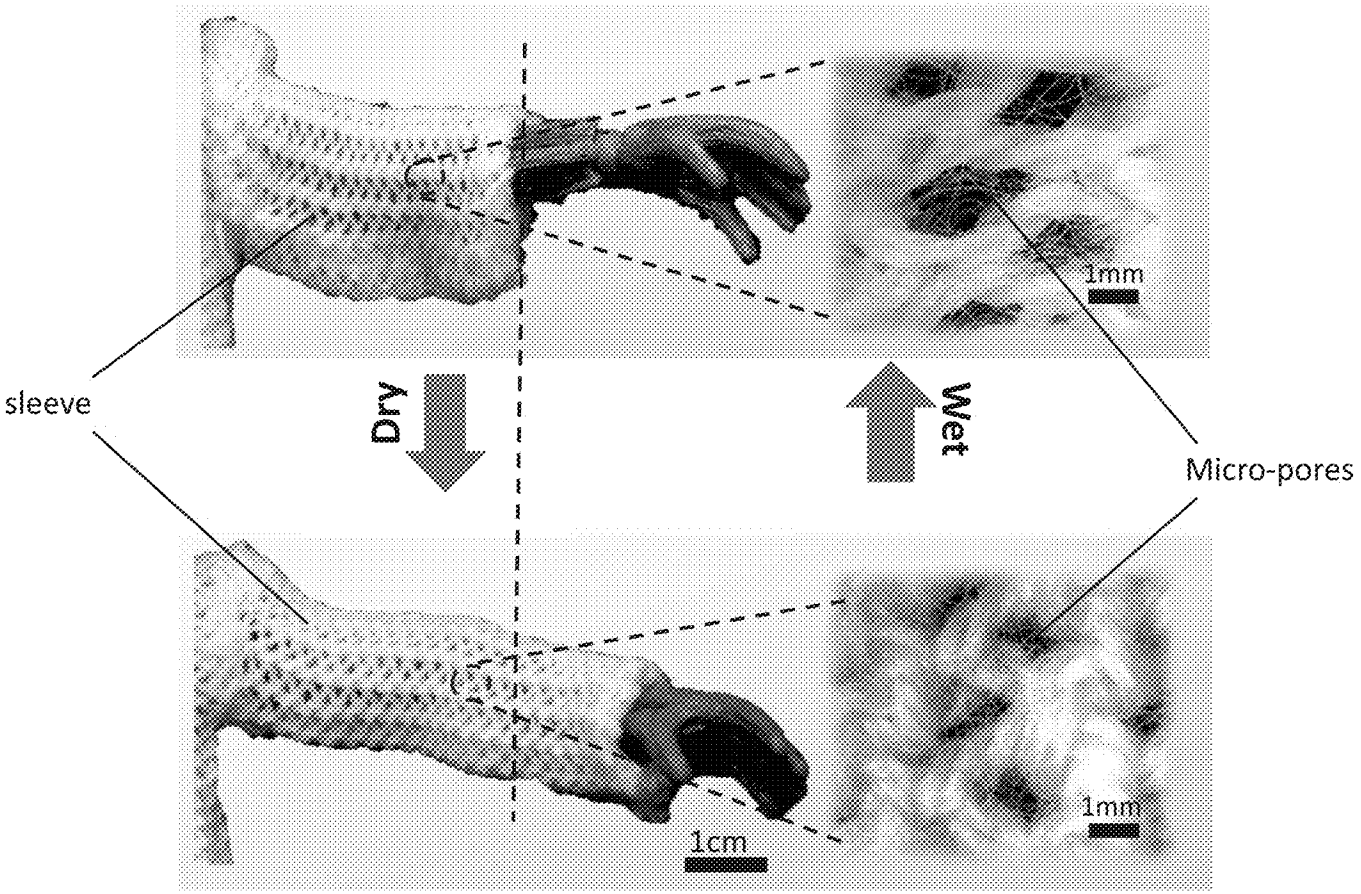
FIG. 7 shows photos illustrating the above-said overall structural change of a sleeve knitted with the BTRF.

FIG. 7 shows photos illustrating the above-said overall structural change of a sleeve knitted with the BTRF. As shown, when the sleeve is getting from dry to wet, the sleeve length is reduced and the sleeve width is increased to facilitate heat loss through radiation and convection. Moreover, the micro-pores of the fabric open simultaneously to maximize the effect of thermal regulation.

Figure 8:
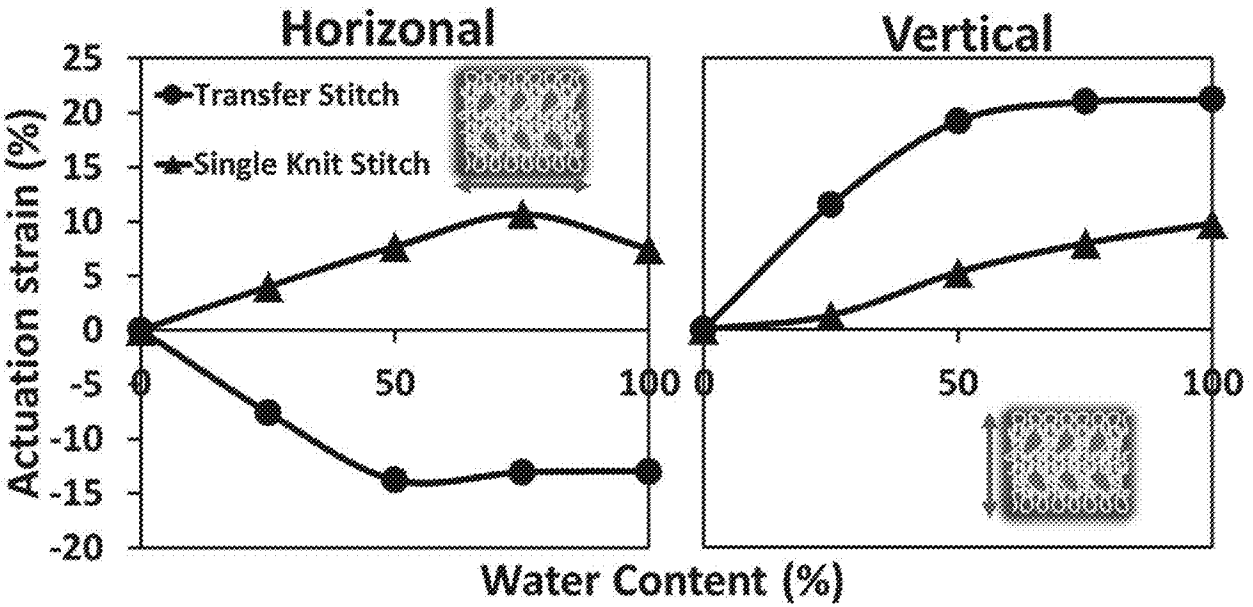
FIG. 8 shows comparison of dimensional response to water between the single knit stitch adopted in conventional fabric and transfer stitch adopted in the BTRF provided by the present invention.
Figure 9:
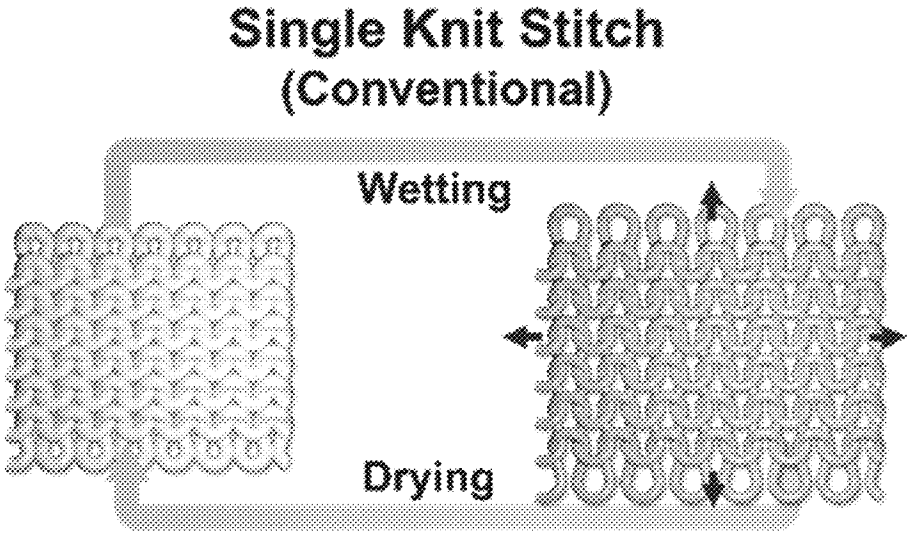
FIG. 9 shows a conventional single knits stitch fabric structure.

FIG. 8 shows comparison of dimensional response to water between the single knit stitch adopted in conventional fabric and transfer stitch adopted in the BTRF provided by the present invention. Results in FIG. 8 show that in a conventional single knits stitch fabric, which has a symmetrical fabric structure (as shown FIG. 9), the extension ratio along the horizonal (wale) and vertical (course) directions are both about 10% after full wetting (100% water content), whereas in the transfer stitch fabric, the extension ratio along the horizonal (wale) and vertical (course) directions are −15% and +20% respectively after full wetting (100% water content).

Figure 10:
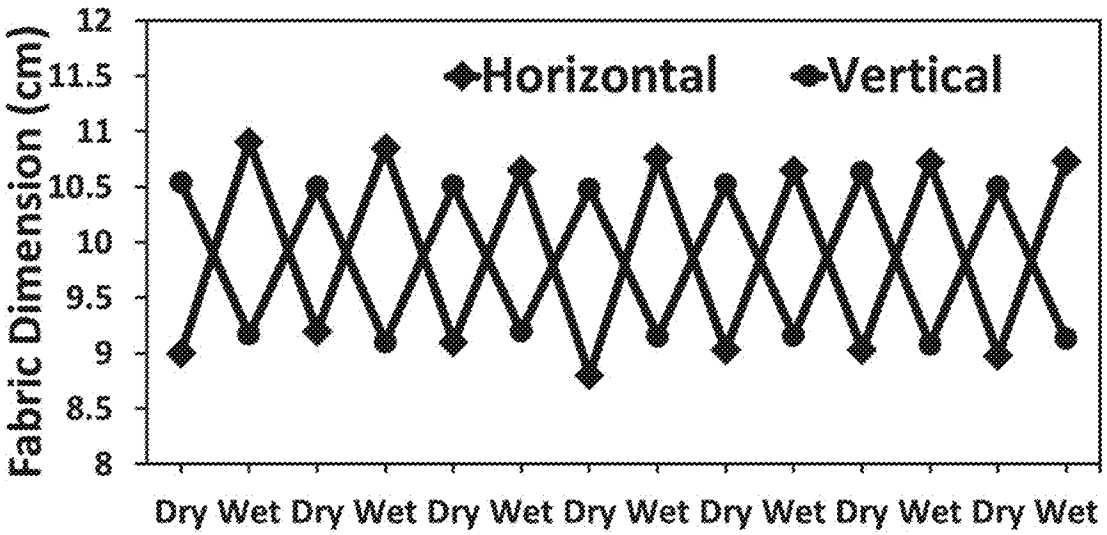
FIG. 10 shows cyclic dry and wet testing results of the BTRF.
Figure 11:
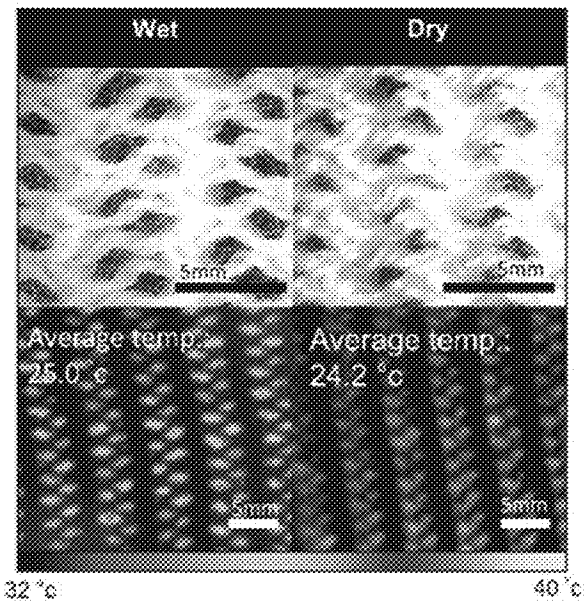
FIG. 11 are photos showing fabric dimension of a BTRF when it is wet or dry.
Figure 12:
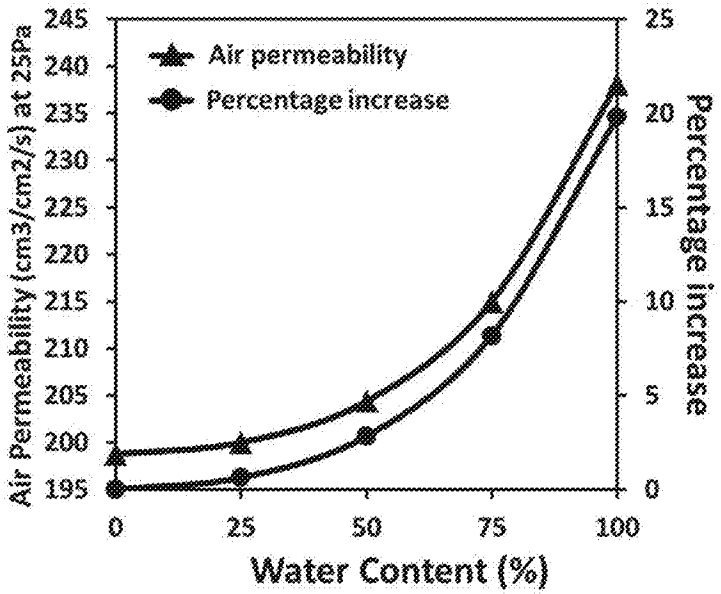
FIG. 12 shows air permeability test results against water content for the BTRF.

The fabric dimension was stable during the cyclic dry and wet testing (as shown in FIG. 10) which shows the potential in garment application. Because of the decrease in yarn thickness, the wool fabric knit using transfer stitches become more permeable when it is wet (as shown in FIG. 11). The developed fabric's infrared transmission is also examined in dry and wet states. The average temperature of the wet fabric's infrared picture is 0.8° C. higher than the dry one, demonstrating the function of the increased radiation permeability. The results of the air permeability test (as shown in FIG. 12) further support the heat regulating effect of water by showing an increase of about 20%.

Figure 14:
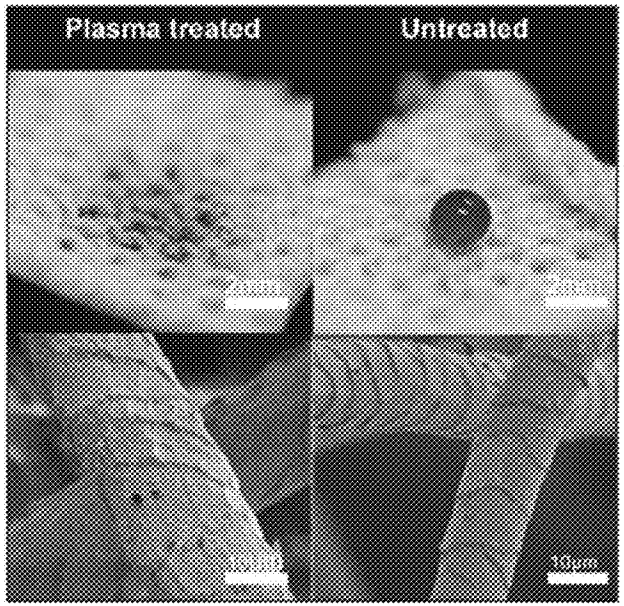
FIG. 14 are photos showing that the BTRF can absorb water drop instantly after the plasma treatment.
Figure 13:
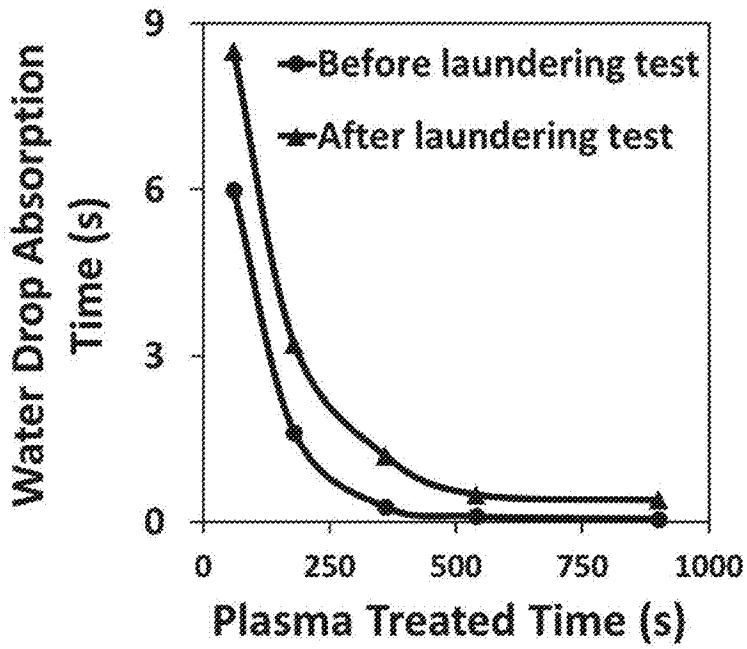
FIG. 13 shows the relationship between water drop absorption time and plasma treated time for the BTRF.

FIG. 13 depicts the relationship between water drop absorption time and plasma treated time. The water drop absorption time reduces gradually along with the plasma treated time. The water absorption speed remained excellent even after the laundering test (simulation of 5 times home laundering). The fabric absorbed the water drop instantly after 900 second of plasma treatment (see FIG. 14), while the untreated one is hydrophobic with a around 120 degrees contact angle.

The surface topology changes of wool fiber after the plasma treatment can also be observed. An increased roughness was brought on by the high-energy electrons bombardment, which increases the contact surface area between the fiber and water. Also, the sharp edges of the scale cells were smoothed out in order to reduce the possibility of fabric shrinkage following washing.

Figure 15:
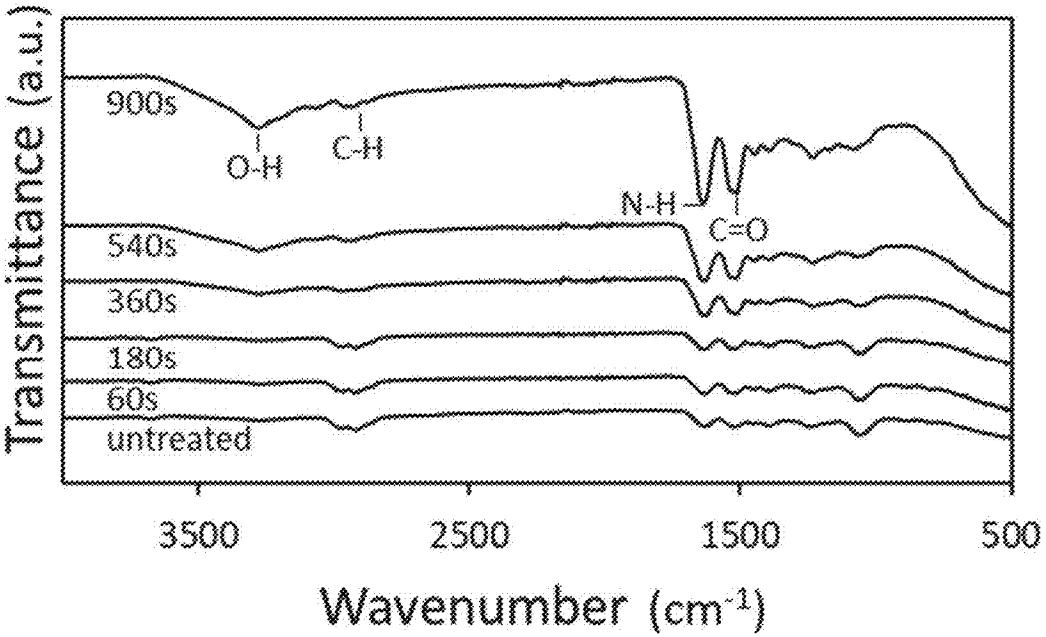
FIG. 15 displays the wool fabric's FTIR spectrum after plasma treatments for various treatment periods.

FIG. 15 displays the wool fabric's FTIR spectrum after plasma treatments for various treatment periods. The —CH3 and —CH2 peak intensities between the 2800 and 3000 $cm^{-1}$ regions are obtained in the untreated specimens, however these intensities dropped and disappeared after the 360s treatment due to the oxidative splitting of the fatty layer. The weak bonds on the polymer chains might be broken by the bombardment of high energy radicals that were produced in plasma. These broken chains might generate low molecular weight compounds with reactive species and —COO and C═O groups, which reduced —CH2 and —CH3. The increased cystic acid from the cleavages of the disulfide bonds caused a significant drop in the transmittance intensity of the cystic acid band at 1041 $cm^{-1}$. The increased hydroxyl group introduced by plasma on the fiber surface is indicated by the transmittance intensity of the —OH stretching vibration increasing steadily at 3292 $cm^{-1}$. The amide I band of the amide carboxyl group C═O stretching vibration and the amide II bands of the N—H bending motion, respectively, correspond to the transmittance bands at 1635 and 1519 $cm^{-1}$, which also increase along with the plasma treatment time, demonstrating the increase of amide linkage (—C(═O)—N(—H)—) concentration. As a result of the oxidation effect of active species created by plasma in the gas phase on the wool surface atoms, these functional groups were produced on the surface of the wool fibers.

The findings clearly showed that the reactive species in the plasma oxidized the major functional groups in wool fiber to form hydrophilic groups and increased the surface roughness of the fiber, both of which significantly increased the absorbency of the fiber. After 540 seconds of plasma treatment, the water drop can be absorbed in 0.5 seconds even after the laundering test, which are excellent for the actuation of BTRF. Although through longer plasma treatments can further increase the water absorption of wool fiber, the cost of production goes up since the energy consumption for plasma generation is high.

As a proof-of-concept demonstration, three kinds of colorimetric sensors into the provided BTRF are incorporated to monitor the pH, UV, and temperature change to provide a facile way to illustrate both body and environmental signals by color change in a real-time manner.

The pH sensor with a range of pH4 to pH7 can detect the sweat pH value. The normal sweat pH level of human beings is around 6.3. Abnormal change of sweat pH can be an indication of body dehydration or muscle fatigue and alert the wearer to potential issues. Apart from that, the UV radiation intensity (up to 5000 $\mu W/cm^2$) and temperature (34° C. to 40° C.) colorimetric sensors reflect the environment status and prevent over exposure of UV radiation and heat stroke. Notably, these sensors do not require any power supply and are therefore compatible with the BTRF system.

Figures 16A, 16B, 16C:
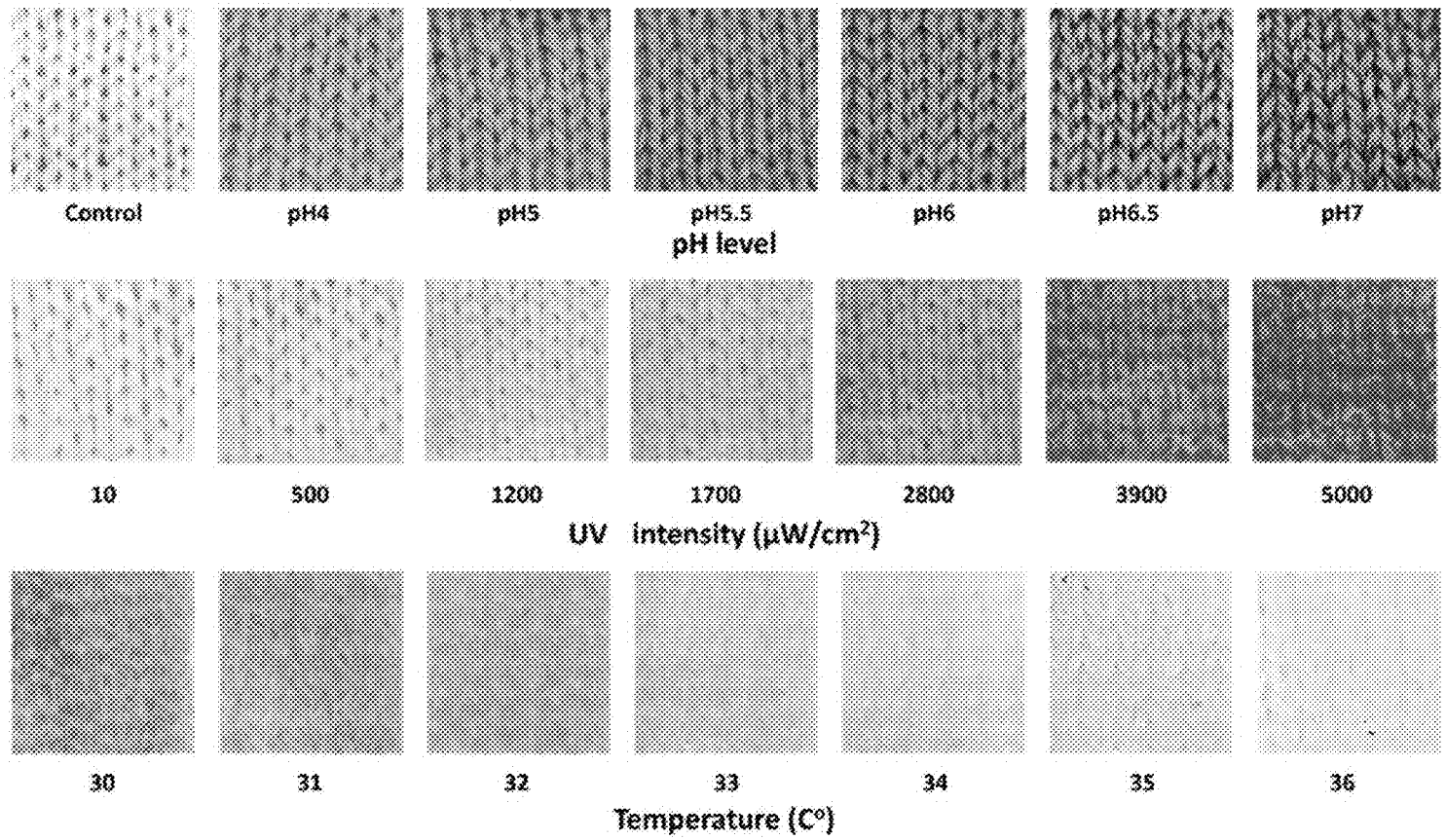
FIGS. 16A to 16C show the color response of the pH, UV and temperature sensors, respectively.
Figures 17A, 17B, 17C:
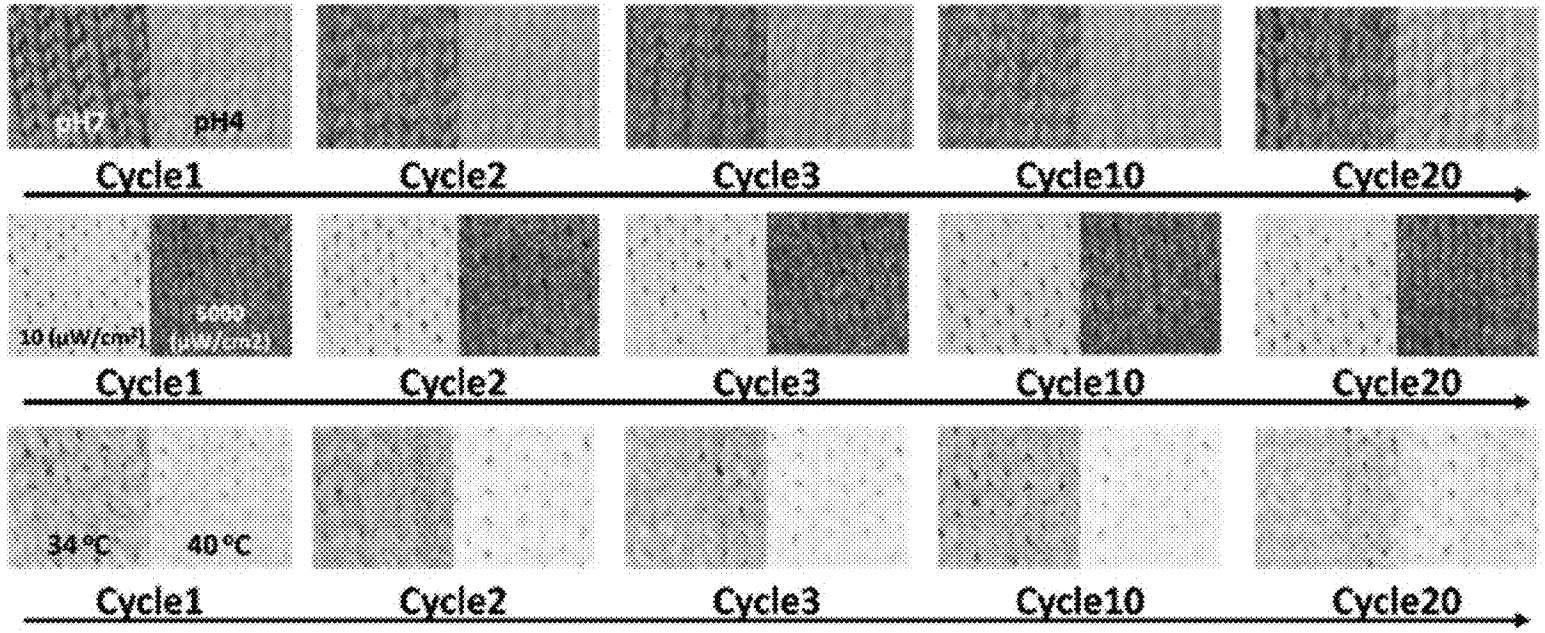
FIGS. 17A to 17C show the cyclic testing results for the pH, UV and temperature sensors, respectively.
Figure 18A:
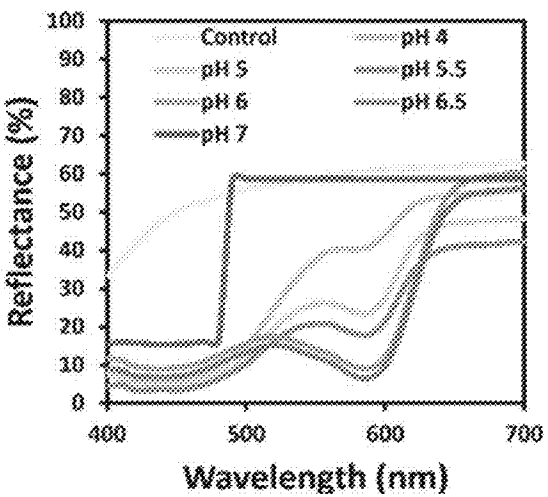
FIGS. 18A to 18C show the spectral reflectance curve of colorimetric sensors under different conditions.
Figure 18B:
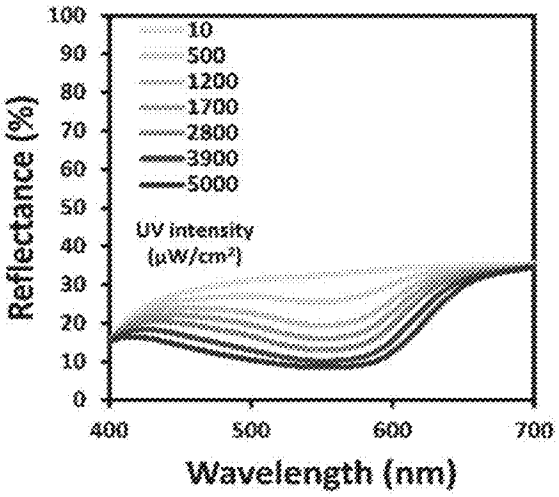
Figure 18C:
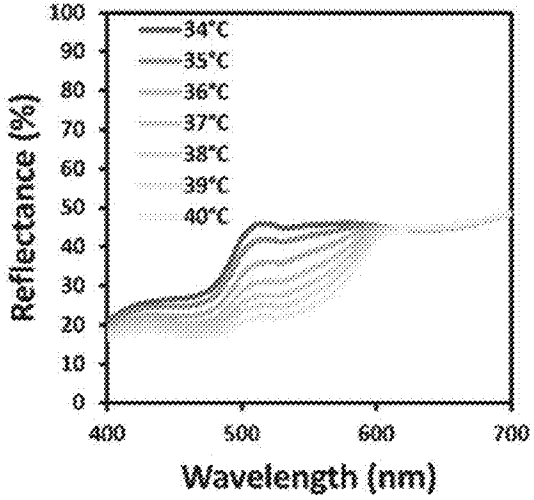

FIGS. 16A to 16C show the color response of the pH, UV and temperature sensors, respectively. FIGS. 17A to 17C show the cyclic testing results for the pH, UV and temperature sensors, respectively. It can be seen that the repeatability of these sensors is superior. FIGS. 18A to 18C exhibit the spectral reflectance curve of colorimetric sensors under different conditions.

For the pH sensing sample, the color of sample changed from yellow to violet (from pH4 to pH7). The reflectance peak drops from a wavelength of around 500 to 650 nm when pH increases from 4 to 6.5. When the pH level reaches to 7, the reflectance band from 500 to 700 nm is completely flatten, demonstrating the disappearance of yellowness of the sample.

For the UV sensing, the intelligent BTRF is capable to detect the UV radiation intensity from around 10 to 5000 $\mu W/cm^2$ by transforming its color from light pink to dark magenta. The reflectance curve is broadly shifted down and become flatten gradually from a wavelength of 400 to 650 nm when the UV radiation intensity increases.

The temperature sensing sample transforms its color from bright red to lemon yellow from 34° C. to 40° C. When the temperature increases, the reflectance band is shifted down gradually from a wavelength 400 to 600 nm.

Figure 19:
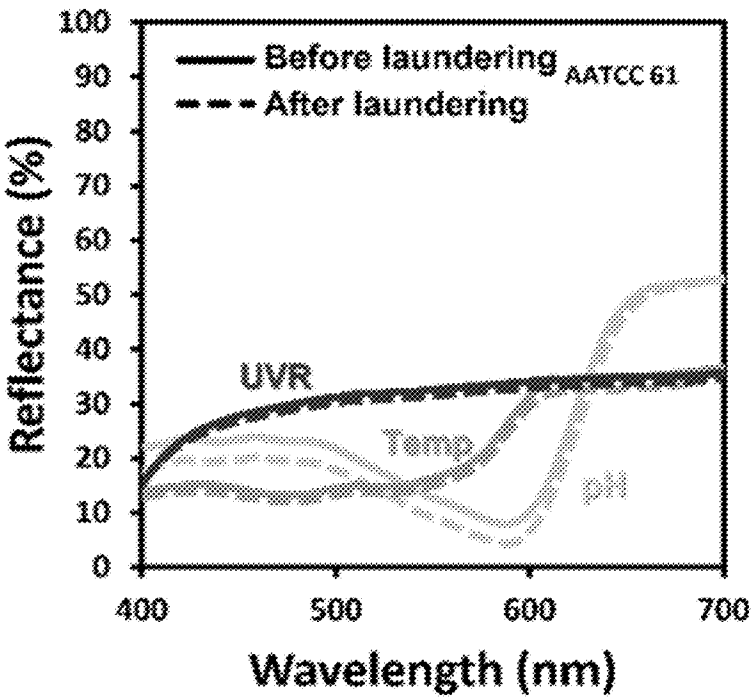
FIG. 19 shows spectral reflectance curves of the BTRF before and after laundering under the AATCC 61 test standard.

In order to confirm the durability of the fabric, the AATCC 61 test standard are conducted to simulate the effect of 5 times home laundry. The spectral reflectance curves (FIG. 19) of all samples did not shift significantly, suggesting the durability of the BTRF to home laundry.

Figure 20:
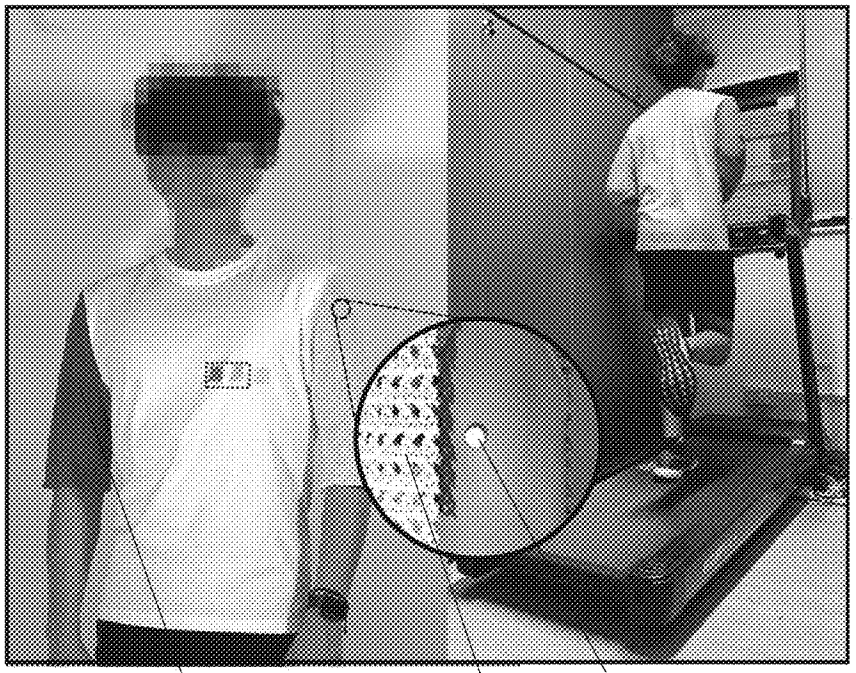
FIG. 20 shows how a wear trial is carried out to thoroughly assess the ability of the BTRF to regulate body temperature.

To thoroughly assess the ability of the BTRF to regulate body temperature, a wear trial was carried out. As shown in FIG. 20, a control fabric was knitted with the same developed structure by using acrylic yarn (commercial substitute for wool yarn). The acrylic yarn has the similar yarn thickness with the wool yarn used in the present invention (around 1.2 mm). The BTRF and control fabric were attached as sleeves on a commercial full cotton T-shirt. The colorimetric sensors were sewn on the left chest area.

A healthy male subject was recruited and instructed to run on the treadmill while wearing the T-shirt in a conditioned room (at 20° C. and 60% RH). To monitor the skin temperature during the experiment, wireless temperature sensors were affixed to the center of the deltoid muscles on both sides of the shoulders of the subject.

Figure 21:
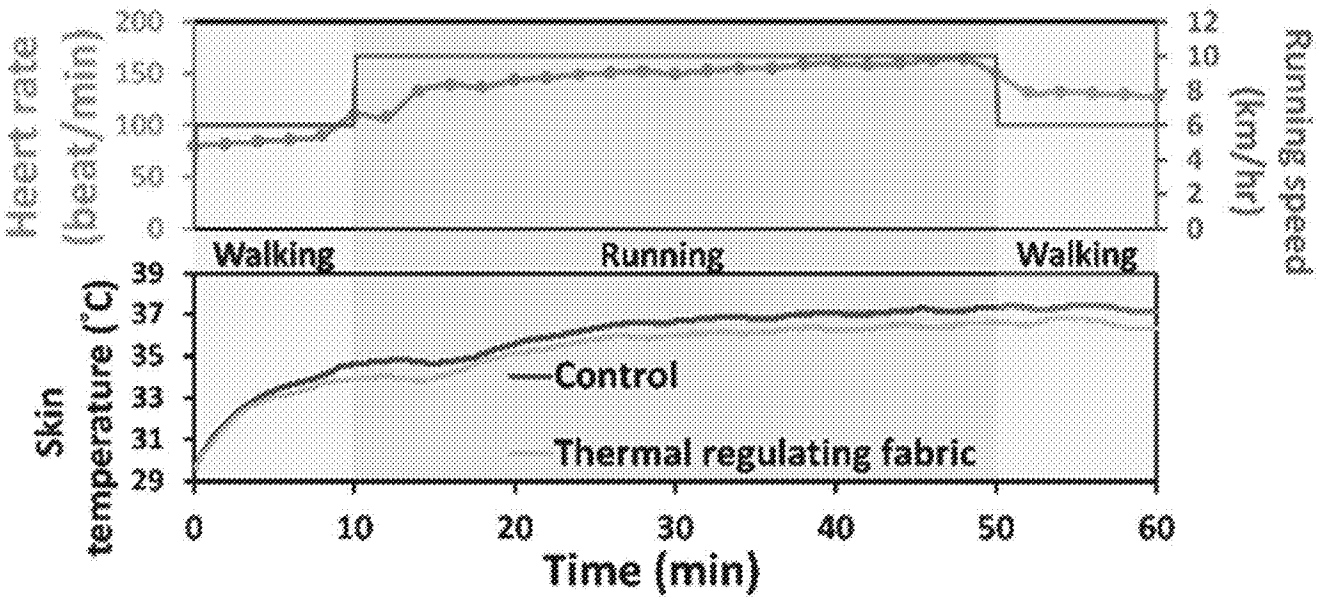
FIG. 21 shows the running speed profile, heart rate and skin temperature of the subject undergoing the wear trial.

FIG. 21 depicts the running speed profile, heart rate and skin temperature of the subject undergoing the wear trial. Due to the comparable thermal behavior of the textiles when they are dry, the change in skin temperature on both shoulders was not noticeable during the first 10 minutes of walking. However, when the participant started running, his perspiration rate increased and the difference in the regulation of body surface temperature between these two fabrics became apparent (by around 0.6 to 0.8° C.).

Figure 22A:
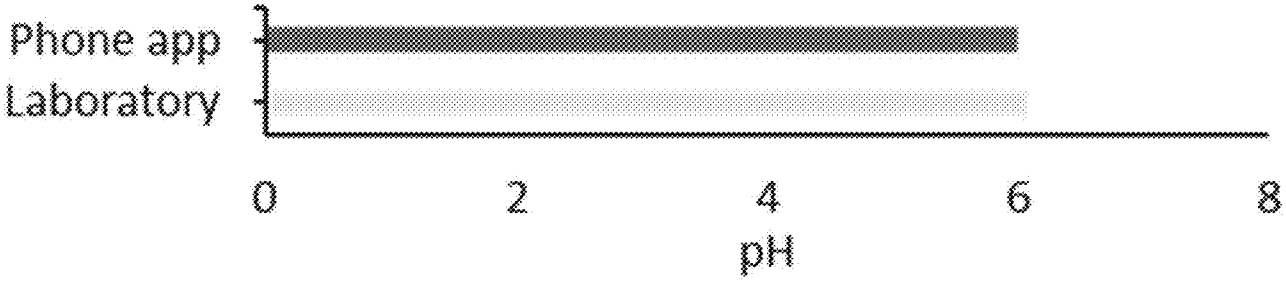
FIGS. 22A and 22B show sweat pH and temperature data of the subject after the wear trial respectively.
Figure 22B:
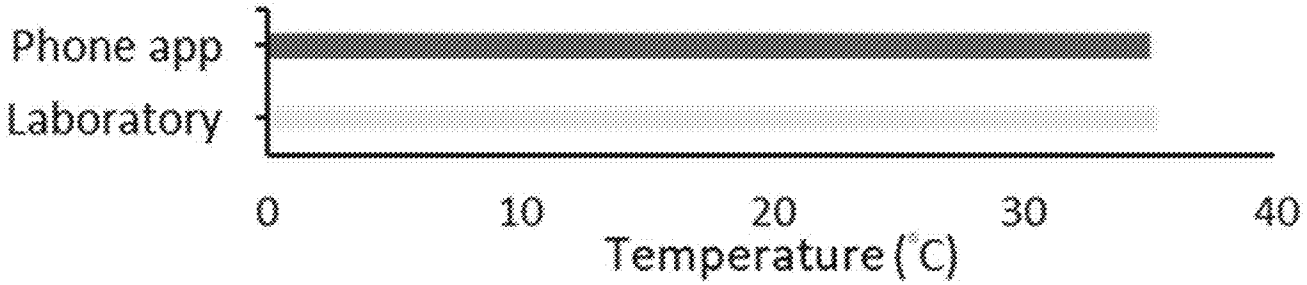

After the wear trial, sweat pH data (FIG. 22A) and temperature data (FIG. 22B) were collected using the developed phone application and compared them with the results from laboratory testing (infrared camera and laboratory electric pH sensor). The data gathered through the phone application was comparable to the outcomes of the laboratory tests, indicating the feasibility of the developed application.

Figure 23:
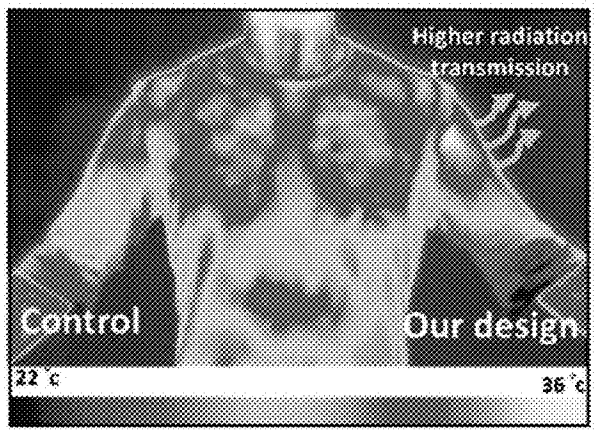
FIG. 23 shows a thermal image of the subject acquired at the end of the wear trial.

FIG. 23 shows a thermal image of the subject acquired at the end of the experiment. With the present invention, a higher radiation transmission on the shoulder wearing the sleeve knitted with BTRF can be observed due to the micro-pores opening effect. Meanwhile, the expansion of the width of the sleeve knitted with BTRF allows less contact area to skin, and a lower temperature is reflected in the thermal image.

Figure 24:
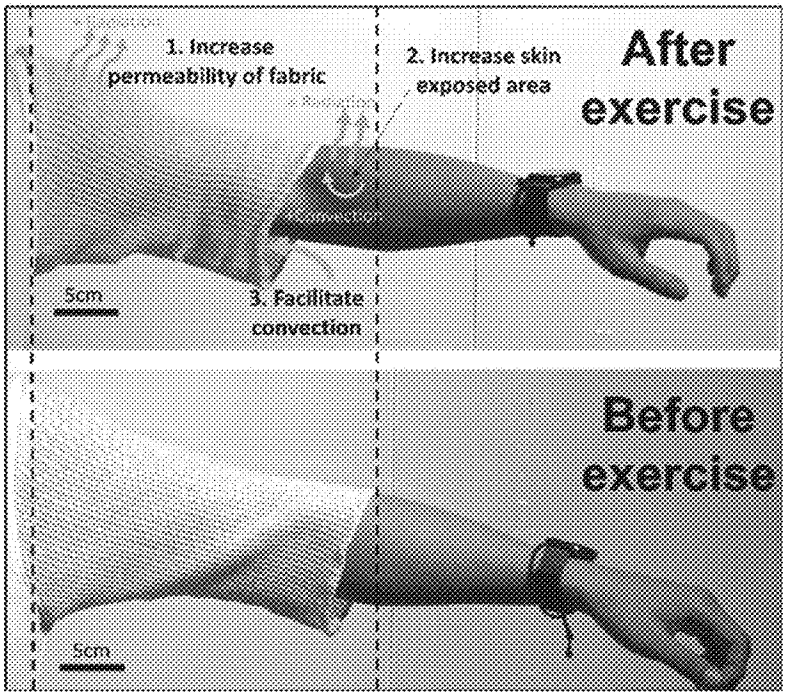
FIG. 24 shows directional shrinkage and expansion effect of a sleeve on a subject during exercise.

Apart from the micro-pores opening effect, the directional shrinkage and expansion effect is demonstrated in FIG. 24. After the fabric absorbed the perspiration during exercise, the sleeves length reduced significantly that increases the exposed area of skin to air, thus causing the increase of heat loss by convection and radiation at these areas. Moreover, the increase of sleeve width also allows air exchange and facilitates the heat loss through convection.

Taken together, inspired by the thermal regulating system of army ant bivouac, the present invention not only rationally combines both water actuated micro-pores opening and overall dimensional change effects together to maximize the fabric's passive temperature regulation capabilities, but it also provides colorimetric assessments of environmental and biological signals which further elevating its applicability and practicability.

Figure 25:
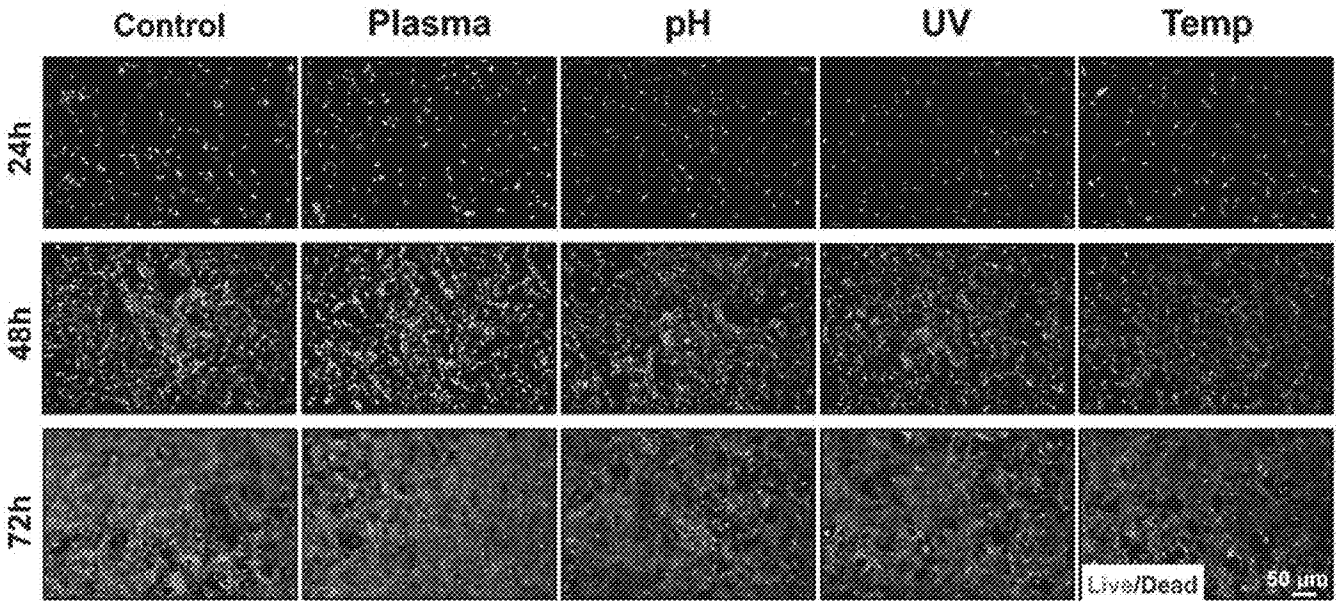
FIG. 25 shows live/dead staining images of a spindle cell morphology on a BTRF in a in vitro study using NIH/3T3 cells.
Figure 26A:
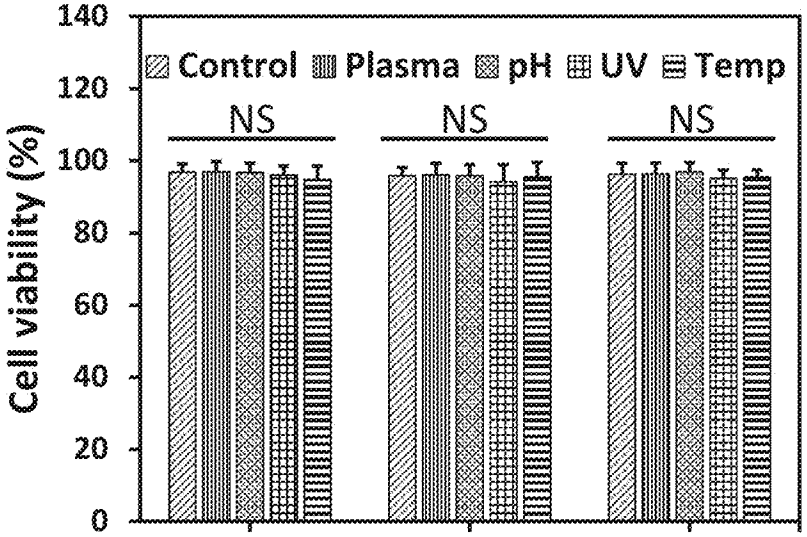
FIGS. 26A and 26B show cell viability and cell proliferation data of various fabric samples, respectively.
Figure 26B:
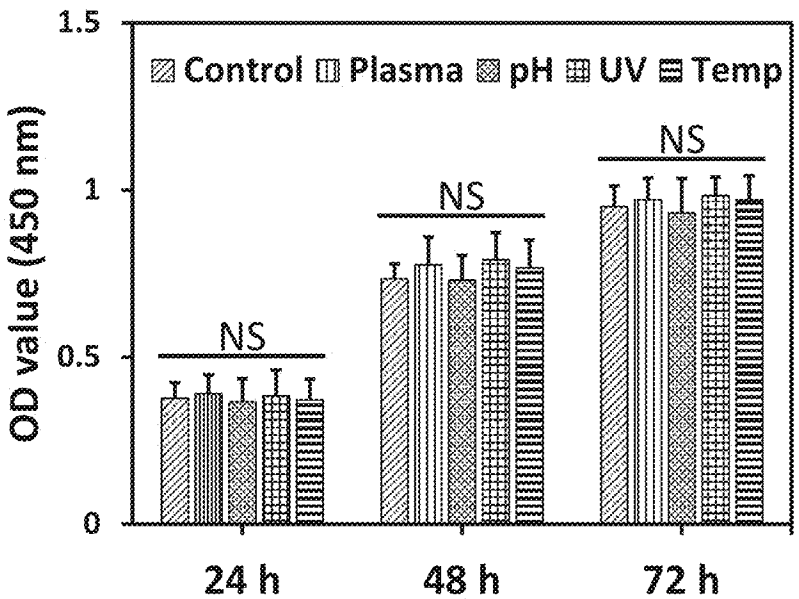
Figure 27:
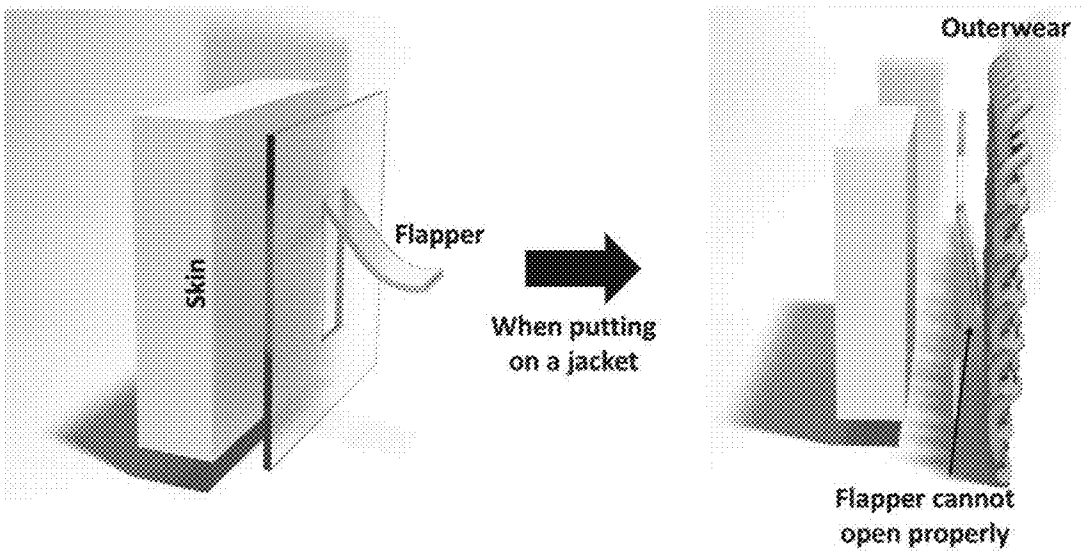
FIG. 27 shows a schematic diagram of a conventional "flapper opening" approach for passive thermal regulation effect.
Figure 28:
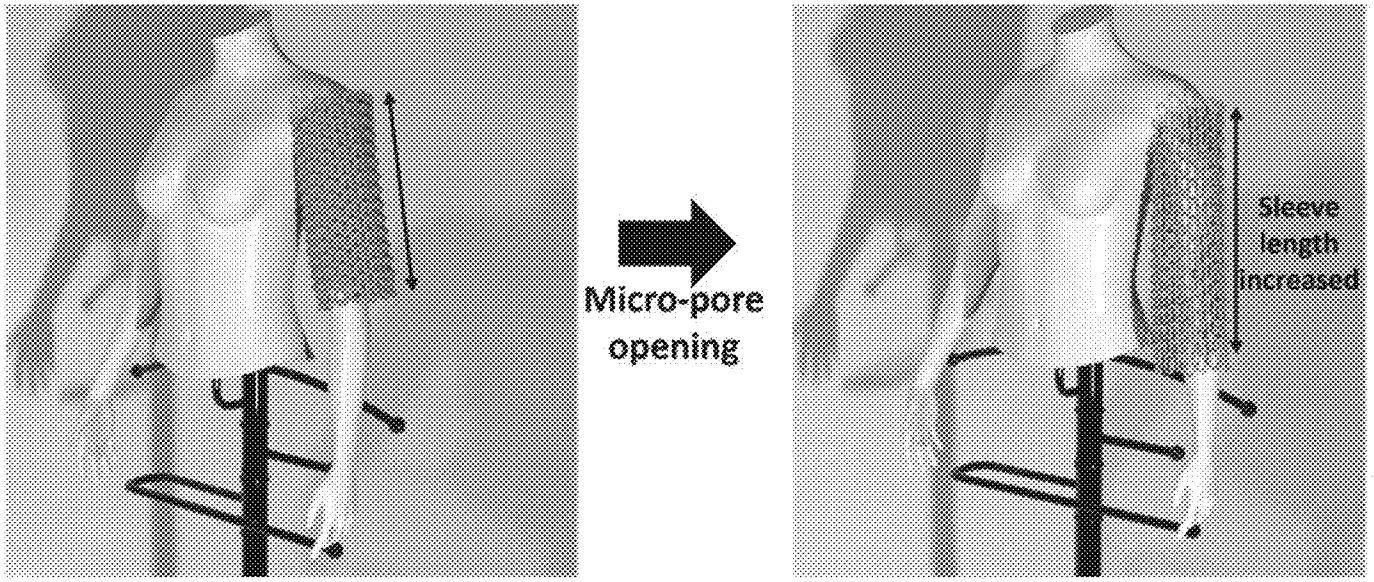
FIG. 28 shows a schematic diagram of a conventional "micro-pore opening" approach for passive thermal regulation effect.
Figure 29:
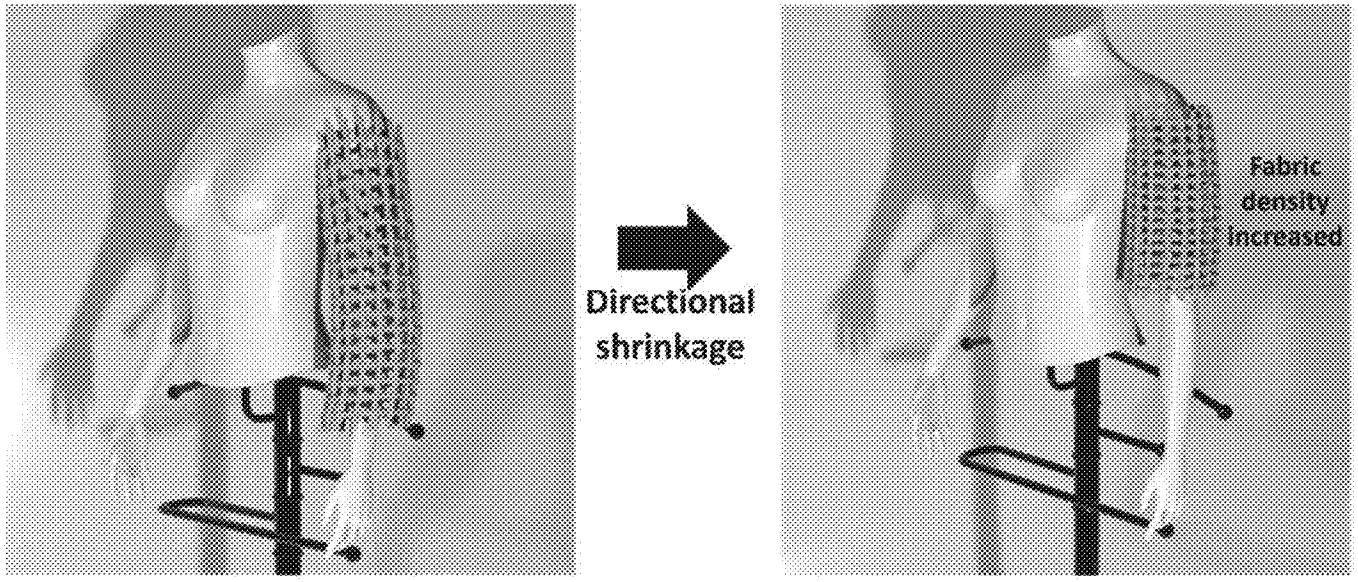
FIG. 29 shows a schematic diagram of a conventional "directional shrinkage" approach for passive thermal regulation effect.

As an outdoor or sport wear fabric, there is a high possibility for the fabric to be touched with skin or even an open wound. Thus, good biocompatibility without skin irritation is highly desirable. The cytotoxicity of the BTRF was evaluated by in vitro study using NIH/3T3 cells as the model cell. As demonstrated in live/dead staining images of a spindle cell morphology (FIG. 25) on a BTRF, almost no dead cell was found in each group, suggesting the ability of the BTRF to support cell survival. Quantification analysis of live/dead-stained cells further confirmed that all groups exhibited excellent cytocompatibility with cell viability greater than 95% after co-culture with fabrics for 24, 48, and 72 hours (FIG. 26A). Moreover, Cell Counting Kit-8 (CCK-8) assay was conducted to assess the cell proliferation onto the fabrics (FIG. 26B). Cell number of all groups increased markedly with incubation time from 24 h to 72 h, and there was no significant difference among these groups. Overall, both live/dead staining and CCK-8 assay indicated that the BTRF provided by the present invention has no detrimental effect on the viability and proliferation of skin fibroblasts and possesses superior biocompatibility.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

What is claimed is:

1. A biomimetic thermal regulating fabric, comprising:

a plurality of yarns formed of textile fibres having a water-actuated crimp behaviour; and wherein the plurality of yarns is knitted by means of transfer stitch to form an unsymmetrical micro-pore fabric structure which has a positive water-actuated expansion rate along a first axis and a negative water-actuated expansion rate along a second axis orthogonal to the first axis.

2. The biomimetic thermal regulating fabric according to claim 1, wherein the textile fibres are wool fibres with surfaces containing one or more hydrophilic functional groups.

3. The biomimetic thermal regulating fabric according to claim 1, further comprises one or more colorimetric fabric sensors configured to generate colours in response to one or more ambient environmental conditions or user physiological conditions respectively.

4. The biomimetic thermal regulating fabric according to claim 3, wherein the one or more colorimetric fabric sensors include a pH level sensor configured to detect a pH level in a range of pH4 to pH7.

5. The biomimetic thermal regulating fabric according to claim 3, wherein the one or more colorimetric fabric sensors include a UV radiation sensor configured to detect a UV radiation intensity in a range of 10 to 5000 $\mu W/cm^2$.

6. The biomimetic thermal regulating fabric according to claim 3, wherein the one or more colorimetric fabric sensors include a temperature sensor configured to detect a temperature in a range of 34° C. to 40° C.

7. A method for constructing a biomimetic thermal regulating fabric, comprising:

preparing a plurality of yarns formed of textile fibres having a water-actuated crimp behaviour; and knitting the plurality of yarns by means of transfer stitch to form an unsymmetrical micro-pore fabric structure which has a positive water-actuated expansion rate along a first axis and a negative water-actuated expansion rate along a second axis orthogonal to the first axis.

8. The method according to claim 7, wherein the textile fibres are wool fibres and the method further comprises processing the fabric structure with plasma treatment to form one or more hydrophilic functional groups on surfaces of the fabric structure.

9. The method according to claim 8, further comprises screen-printing or dying one or more colorimetric fabric sensors on the fabric structure to generate colours in response to one or more ambient environmental conditions or user physiological conditions respectively.

10. The method according to claim 9, wherein the one or more colorimetric fabric sensors include a sweat pH level sensor configured to detect a sweat pH level in a range of pH4 to pH7.

11. The method according to claim 9, wherein the one or more colorimetric fabric sensors include a UV radiation sensor configured to detect a UV radiation intensity in a range of 10 to 5000 $\mu W/cm^2$.

12. The method according to claim 9, wherein the one or more colorimetric fabric sensors include a temperature sensor configured to detect a temperature in a range of 34° C. to 40° C.

13. A garment made of the biomimetic thermal regulating fabric of claim 1.

14. The garment of claim 13, comprising a pair of sleeves each sleeve being knitted with the biomimetic thermal regulating fabric to achieve an unsymmetrical fabric structure which has a negative water-actuated expansion rate along an arm axis and a positive water-actuated expansion rate along another axis orthogonal to the arm axis.

15. The garment of claim 13, comprising a pair of pants, each pant being knitted with the biomimetic thermal regulating fabric to achieve an unsymmetrical fabric structure which has a negative water-actuated expansion rate along a leg axis and a positive water-actuated expansion rate along another axis orthogonal to the leg axis.

* * * * *